United States Patent [19]

Thackray

[11] 4,107,580

[45] Aug. 15, 1978

[54] BALLAST CIRCUIT FOR GAS GLOW DISCHARGE DEVICES

[76] Inventor: Philip C. Thackray, 14 S. Drive, Valencia, Pa. 16059

[21] Appl. No.: 771,671

[22] Filed: Feb. 24, 1977

[51] Int. Cl.[2] ..... H05B 41/392; G05F 1/52

[52] U.S. Cl. ..... 315/311; 315/208; 315/307; 323/4

[58] Field of Search ..... 315/311, 307, 291, 208, 315/DIG. 7

[56] References Cited

U.S. PATENT DOCUMENTS

| | | | |
|---|---|---|---|
| 3,238,415 | 3/1966 | Turner | 315/311 X |
| 3,560,842 | 2/1971 | Caprari | 315/311 X |
| 3,801,867 | 4/1974 | West et al. | 315/311 X |
| 3,806,762 | 4/1974 | Punis et al. | 315/307 |

*Primary Examiner*—Alfred E. Smith
*Assistant Examiner*—Charles F. Roberts
*Attorney, Agent, or Firm*—Buell, Blenko & Ziesenheim

[57] ABSTRACT

The ballast circuit comprises a transistor having its collector and emitter and an emitter resistor in series with an alternating current operated current-controlled power supply and a gas discharge load device, such as a He-Ne gas laser. The transistor base is biased by a resistance voltage divider between the collector and the other end of the emitter resistor. A decoupling capacitor is connected between that end of the emitter resistor and the base.

4 Claims, 1 Drawing Figure

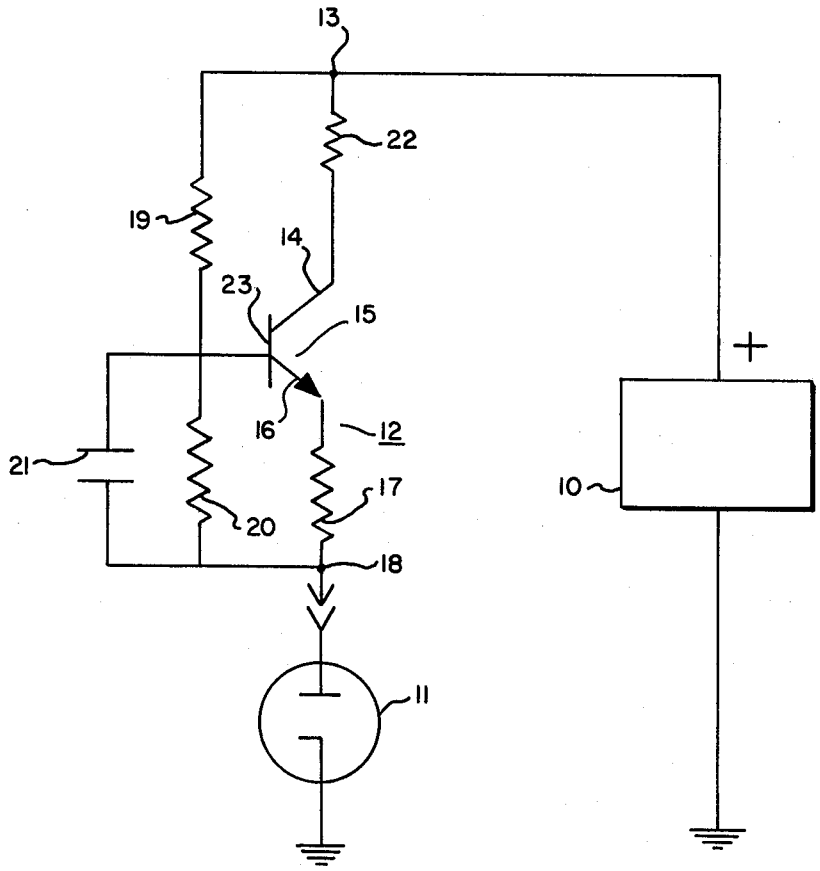
13
22
19
14
23
15
+
16
12
21
17
10
20
18
11

BALLAST CIRCUIT FOR GAS GLOW DISCHARGE DEVICES

This invention relates to a voltage supply ballast circuit for gas glow discharge devices. It is more particularly concerned with a self-biasing circuit for alternating current operated voltage supply circuits having a ripple voltage superimposed on a direct voltage output.

Many gas discharge devices such as He-Ne gas lasers require high operating direct voltage, in the range of 1,000 to 2,500 volts. A pecularity of such devices is that they appear to their voltage as negative resistances and the voltage supply must therefore include a positive resistor of a value greater than the negative resistance of the load if stable operation of the latter is to be obtained. The load currents of those devices are at least several milliamperes, for example, certain lasers require about 7ma at 1650 volts. The power required by such a device is thus $0.007 \times 1650 = 11.55$ watts. Lasers of that type, however, require a series resistor on the order of 100,000 ohms for stable operation. The power loss in that resistor is $0.007^2 \times 100{,}000$ or 4.9 watts. The aggregate power required is thus 16.45 watts, about 30% of which is dissipated in the ballast resistor.

Various circuits have been proposed to reduce that power loss. Those with which I am familiar all have the defect of requiring rather careful adjustment to the particular load supply. In lasers, for example, the operating voltage may vary several hundred volts among tubes of the same type drawing the same load current. Furthermore, the tube characteristics change with time, and periodic compensatory adjustment of those circuits are required. Obviously, such circuits are not well suited for mass-produced voltage supply apparatus intended to operate lasers of a particular type.

It is an object of my invention to provide a self-biasing or self-adjusting ballast circuit for use with direct voltage supplies for gas discharge devices. It is another object to provide such a circuit having reduced power dissipation. It is another object to provide such a circuit which can be adjusted to cancel ripple voltages only up to a predetermined value, and thus limit power dissipation so involved. Other objects of my invention will appear in the description thereof which follows.

Embodiments of my invention presently preferred by me are shown in the attached FIGURE which is a schematic diagram of my apparatus.

My apparatus comprises, briefly, a transistor having its collector and emitter, and an emitter resistance, in series with an alternating current operated current-controlled power supply and a gas discharge load device, such as a laser. The transistor base is biased by a resistance voltage divider between the collector and the other end of the emitter resistor. A decoupling capacitor is connected between that end of the emitter resistor and the base.

In the FIGURE a conventional alternating current operated current-regulated voltage supply 10 is connected to a conventional laser 11 through a ballast circuit 12 of my invention. As shown, high voltage supply 10 has its negative terminal grounded but my apparatus is adaptable for either negative or positive ground supply, as will appear. Input terminal 13 of my ballast circuit 12 is connected to collector 14 of npn junction transistor 15 through current limiting resistor 22. Emitter 16 of transistor 15 is connected through resistor 17 to output terminal 18. Terminal 13 is connected through resistor 19 to base 23 of transistor 15 and base 23 is connected to output terminal 18 through resistor 20 which is paralleled by decoupling capacitor 21. That capacitor is large enough to decouple high frequency ripple voltage on the output of voltage supply 10.

In the operation of my apparatus to be described hereinafter, resistor 22 is ignored. As has been mentioned, that resistor serves to limit the current flow through transistor 15 under fault conditions and also serves to reduce the voltage across the transistor, but otherwise has no significant effect.

For all frequencies decoupled at transistor base 23 by capacitor 21, the impedance between terminals 13 and 18 appears to be a resistance with the value of resistor 19. That resistor must be larger than the negative resistance of 11, and typically may have a value of 100,000 ohms. If a load current $i$ flows through ballast circuit 12, the voltage across resistor 17 will be $ir_{17}$. By feedback action, transistor 15 will adjust the voltage at 13 so that the voltage across resistor 20 is equal to $ir_{17} + V_{be}$ where $V_{be}$ is the base-to-emitter voltage of transistor 15. Since $r_{19}$ and $r_{20}$ form a simple voltage divider, $$ir_{17} + V_{be} = (V_{12}\, r_{20})/(r_{19} + r_{20})$$

where $V_{12}$ is the voltage between terminals 13 and 18. If $ir_{17}$ is much greater than $V_{be}$, as is in fact the case, $V_{be}$ can be ignored and the equation can be written:

$$V_{12} = [(r_{19} + r_{20})/r_{20}]\, ir_{17}$$

Thus, the direct voltage across ballast circuit 12 is a function of fixed resistance values and the load current.

This condition is stable. If the voltage on base 23 of transistor 15 should decrease, collector 14 would go positive because it is driven by a current source. This would have the effect of raising the voltage on base 23. If the voltage on base 23 should increase, the transistor 15 would turn on more, which would have the effect of lowering the voltage on base 23.

The values of $r_{17}$ and $r_{20}$ are selected so that high-voltage supply ripple will not cause transistor 15 to saturate. About 15 volts of ripple are blocked by setting the collector-base voltage of transistor 15 at 12 volts.

Only enough current need flow through $r_{19}$ and $r_{20}$ to render the base current of transistor 15 negligible. If the collector current is 5 ma and the transistor $\beta$ about 200, $i_b$ will be about 25 ua. About 200 ua, therefore, will be sufficient for the current through $r_{19}$ and $r_{20}$. Typical values of $r_{20}$ and $r_{17}$ are 40,000 ohms and 1,000 ohms, respectively.

The current regulated voltage supply used with my apparatus should have a low frequency resistance which exceeds the negative resistance of the laser because my ballast circuit provides a high resistance only for the range of frequencies that are decoupled by capacitor 21. The direct current and low frequency resistance requirements of the laser must be met by the current regulated high voltage supply.

A prior art ballast circuit resembles the circuit of FIG. 1 above described in some respects, but in place of the parallel combination of $r_{20}$ and $c_{21}$ has a Zener diode. In that circuit transistor action causes the voltage across $r_{17}$ to equal the Zener voltage, less $V_{be}$. With that voltage fixed the transistor 15 appears as a current source and the total resistance between terminals 13 and 18 is $r_{19}$ which, of course, must be made higher than the load negative resistance. However, the Zener diode current flows through $r_{19}$. If that current is 1 ma, the voltage across $r_{19}$ is 100 volts, and the total voltage drop from terminal 13 to terminal 18 is that voltage plus Zener voltage. The latter may be on the order of 6 volts.

The above conditions are, of course, ideal, but require that the voltage between terminals 13 and 18 be maintained at the FIGURE above mentioned. If that voltage decreases, the Zener diode resistance will increase and effective current control is then lost. If the voltage increases, the dissipation is increased. Since lasers of the same type may have operating voltages which vary several hundred volts at the same current, the ballast circuit must be set to maintain the 100 volts plus Zener voltage drop between terminals 13 and 18 for the worst operating conditions. For all other lasers, the power dissipation will be greater. The circuit will block ripple voltage, but the voltage drop from terminal 13 to terminal 18 is far higher than any ripple voltage normally found in an alternating current operated power supply, and the circuit is not economical for that purpose.

The circuit of FIG. 1 may be adapted for positive ground installations reversing terminals 13 and 18 of ballast circuit 12.

In the foregoing specification I have described presently preferred embodiments of my invention; however, it will be understood that my invention can be otherwise embodied within the scope of the following claims.

I claim:

1. A ballast circuit for a ripple-containing voltage supply to a negative resistance load comprising a transistor, a first resistor connected between its emitter and a load terminal, means connecting its collector to a voltage supply terminal, a second resistor connected between its collector and its base, a third resistor connected between its base and the said load terminal, and a decoupling capacitor connected in parallel with the third resistor, the value of the second resistor being adjusted to exceed the negative resistance of the load and the voltage between transistor base and collector being adjusted to a value preventing the saturation of the transistor by the ripple voltage.

2. The circuit of claim 1 in which the voltage across the ballast circuit equals the sum of the second and third resistors, divided by the third resistor, multiplied by the product of the load current by the first resistor.

3. The circuit of claim 1 in which the ripple-containing voltage supply is a current-regulated voltage supply.

4. The circuit of claim 1 in which the negative resistance load is a gas discharge laser and the ripple-containing voltage supply is a current-regulated voltage supply having a direct current output resistance which exceeds the negative resistance of the laser.

* * * * *

UNITED STATES PATENT AND TRADEMARK OFFICE

CERTIFICATE OF CORRECTION

PATENT NO. : 4,107,580

DATED : August 15, 1978

INVENTOR(S) : Philip C. Thackray

It is certified that error appears in the above-identified patent and that said Letters Patent are hereby corrected as shown below:

Column 1, line 13, after "voltage", --supplies-- should be inserted.

Signed and Sealed this

*Sixth* Day of *March 1979*

[SEAL]

*Attest:*

RUTH C. MASON
*Attesting Officer*

DONALD W. BANNER
*Commissioner of Patents and Trademarks*